US011076639B2

(12) United States Patent
Machina

(10) Patent No.: US 11,076,639 B2
(45) Date of Patent: Aug. 3, 2021

(54) WIRE HOLDER FOR PAPER ROLLED CIGARETTES

(71) Applicant: 420 Coach Company, Pompano Beach, FL (US)

(72) Inventor: Morgan Henry Machina, Middleton, WI (US)

(73) Assignee: 420 Coach Company, Pompano Beach, FL (US)

( * ) Notice: Subject to any disclaimer, the term of this patent is extended or adjusted under 35 U.S.C. 154(b) by 0 days.

(21) Appl. No.: 17/135,611

(22) Filed: Dec. 28, 2020

(65) Prior Publication Data

US 2021/0195945 A1 Jul. 1, 2021

Related U.S. Application Data

(60) Provisional application No. 62/954,317, filed on Dec. 27, 2019.

(51) Int. Cl.

| | |
|---|---|
| ***A24C 5/44*** | (2006.01) |
| ***A24F 13/22*** | (2006.01) |
| ***A24D 1/02*** | (2006.01) |

(52) U.S. Cl.

CPC ..... *A24F 13/22* (2013.01); *A24C 5/44* (2013.01); *A24D 1/022* (2013.01)

(58) Field of Classification Search

CPC ..... A24F 13/22; A24D 1/022; A24C 5/44
USPC ..... D27/194, 196
See application file for complete search history.

(56) References Cited

U.S. PATENT DOCUMENTS

| | | | |
|---|---|---|---|
| 889,207 | A | 6/1908 | Crane |
| 4,033,358 | A | 7/1977 | Harrington |
| 4,242,170 | A | 12/1980 | Harrington et al. |
| 4,259,140 | A | 3/1981 | Harrington |
| 4,319,588 | A | 3/1982 | Evans |
| 2009/0223528 | A1 | 9/2009 | Katigbak |

*Primary Examiner* — Eric Yaary
(74) *Attorney, Agent, or Firm* — The Concept Law Group PA; Scott D. Smiley; Scott M. Garrett

(57) ABSTRACT

A rolling paper with an attached thin heat-resistant wire is manufactured and connected at the base of the rolling paper, by means of an adhesive or other substance or manner that allows the wire to be connected to the rolling paper. Wire holders can also be inserted into the rolled tobacco or cannabis product after being rolled. Wire holders may be one or more pieces, where multiple pieces can be connected together to form the wire holder assembly. Insulation or a non-heat-conducting component may be part of the wire holder, intended to be held by the user to avoid discomfort from a heated wire, or to have residue from the rolled product while smoking. Specialized dispensers hold the wired rolling papers, or the wires.

12 Claims, 12 Drawing Sheets

WIRE HOLDER FOR PAPER ROLLED CIGARETTES

CROSS REFERENCE

This application claims the benefit of U.S. provisional application No. 62/954,317, filed Dec. 27, 2019, the entirety of which is hereby incorporated by reference.

FIELD OF THE INVENTION

The present invention relates generally to materials for use in rolling cigarettes, and particularly to a non-combustible structure that is incorporated into a rolled cigarette that allows a user to hold the cigarette without having to hold the paper or filter of the cigarette and which adds stiffness to the paper to facilitate rolling the cigarette.

BACKGROUND OF THE INVENTION

Many people enjoy rolling their own cigarettes and there are a large number of products available for doing so, including a variety of smoking materials such as flavored tobaccos, various types of rolling papers, and so on. People have been rolling cigarettes for well over one hundred years, and yet, despite that long time, some problems still persist. For one, rolling papers are very flexible and it is easy to accidently tear or fold a rolling paper. Thus, a user must take great care in removing a rolling paper from a package and holding it while placing the smoking material in the paper. Another problem is that the burning smoking material can burn a user's fingers or transfer tar residue to fingers while holding the rolled cigarette.

Therefore, a need exists to overcome the problems with the prior art as discussed above.

DRAWINGS

DETAILED DESCRIPTION

Figure 1:
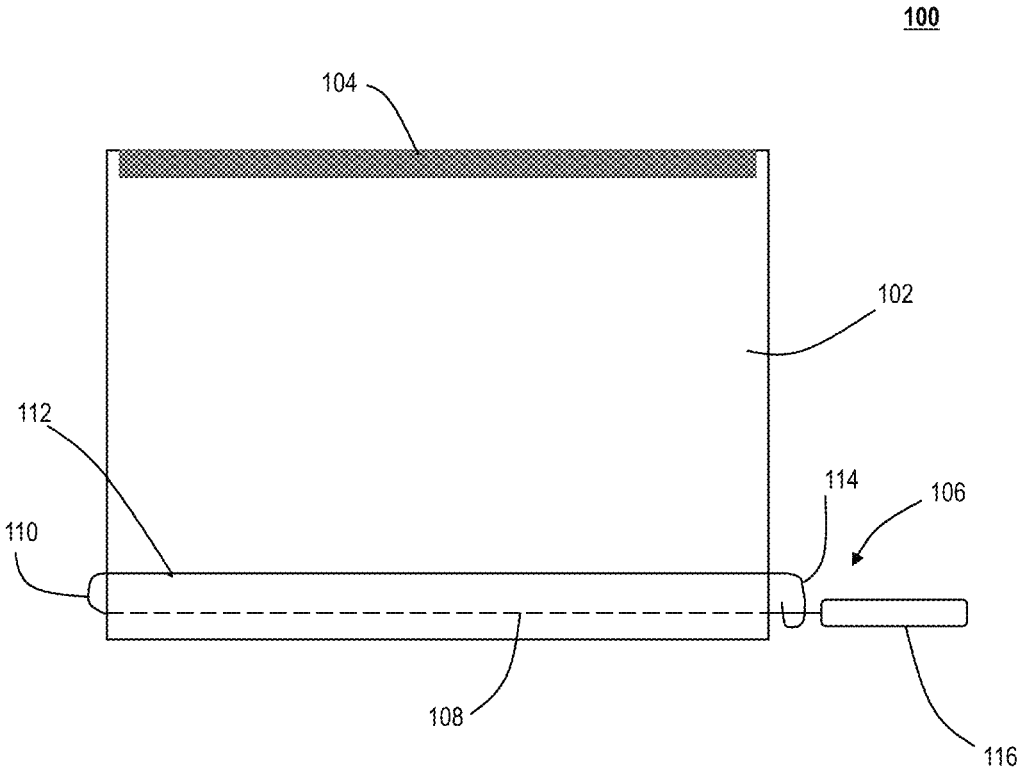
FIG. 1 shows a unrolled rolling paper having an attached wire holder, in accordance with some embodiments.

Although the invention is illustrated and described herein as embodied in a linerless label structure, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances. The term "wire holder" as used herein refers to a structure formed with a semi-rigid rigid wire that is used to allow a user to hold a smoking item (cigar, cigarette). The wire of the wire holder is made of a non-reactive material that does not burn or produce by-products when exposed to the burning ember of a smoking item, such as steel or aluminum alloys used in constructing cookware. Further, the wire is rigid enough to hold its shape when bent.

Some embodiments of the disclosure are intended to provide added structure and stiffness to the bottom of a rolling paper for easier rolling of the tobacco or *cannabis* or other ground substances. This invention is also intended to allow the smoker of the rolled product to more easily smoke the product with less risk of excessive heat or burning of the smoker, most often occurring in the fingers or hand or face of the smoker. This invention has a protruding heat-resistant wire intended to be held by the smoker of the rolled product in a manner to avoid burning themselves, transferring tar residue from the burning product to the fingers, and to allow the rolled product to be smoked all the way down to the non-protruding portion of the wire. The protruding end may have an insulating wrap to be held for further reducing any risk of burning. Normally a smoker would hold the protruding end of the wire or insulating wrap between a finger and thumb with one hand, so the rolled product may be easily lit or smoked.

Some embodiments of the disclosure include specially made holders for the wired rolling papers, so that users can easily extract one wired paper at a time.

Some embodiments of the disclosure include individually made heat-resistant wires that are made to protrude in various lengths, configurations, and sizes, to be used with all sizes of rolling papers, and all sizes of rolled products.

Some embodiments of the disclosure include specially made holders for the wires, so that one wire can be easily extracted from the wire holder at a time.

Some embodiments of the disclosure can include assemblies of more than one wire, where one wire is rolled in the rolling paper with an end that protrudes, and another wire or insulated connecting piece may be added to the protruding end, allowing for additional methods of holding the rolled product, in various configurations, and further away from where the product is being heated or lit.

Figure 2:
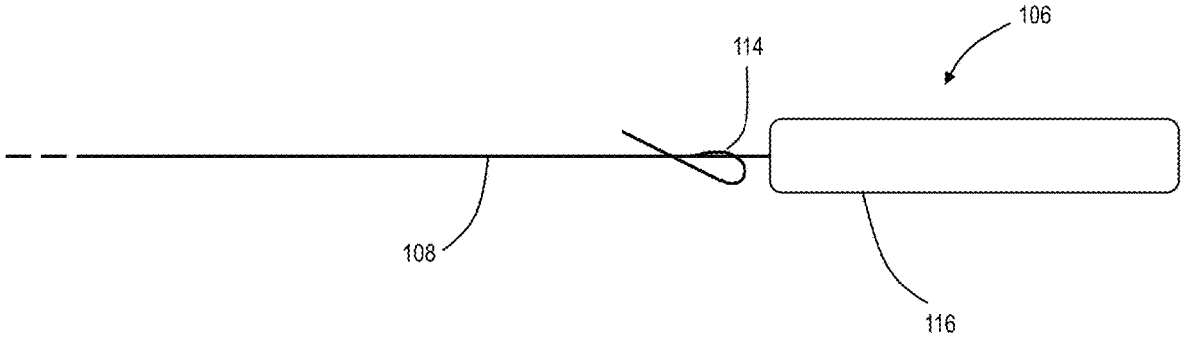
FIG. 2 shows a side view of a wire holder for a rolling paper, in accordance with some embodiments.

FIG. 1 shows a unrolled rolling paper 102 having an attached wire holder 106 for a rolling paper system 100, in accordance with some embodiments. The rolling paper 102 can be used to roll a cigarette for smoking. Smoking materials can be placed in the rolling paper 102, which is then rolled substantially to a cylindrical form to create the cigarette. The rolling paper 102 is generally rectangular having two sides/surfaces and four edges. At a top edge there can be a gumming material 104 that is moisture activated to cause the rolling paper to stay rolled (closed) after being rolled. At the bottom edge, and overlapping the rolling paper, is a wire holder 106 that has two portions. A first portion 108 passes over the rolling paper 102 on a first or front side, and the second portion 112 passes over the rolling paper on the second side of the rolling paper (i.e. on the other side from the first portion). The wire passes from the first side of the rolling paper to the second side of the rolling paper at a first end 110 of the wire insert. The second portion 112 across the width of the rolling paper, and can engage the first portion of the wire insert such as by a hook or loop 114 formed at the end of the second portion 112 at the second end of the wire insert. The first portion 108 of the wire insert can have an extension that extends outward from the edge of the rolling paper and which is covered with a thermal insulating material to form a handle 116 as a gripping portion. The wire holder 106 can be either placed over the rolling paper 102 by a user, or the it can be attached to the rolling paper 102 such as by a gumming or adhesive material by the manufacturer of the rolling paper 102. Upon being rolled, the handle 116 will extend from the end of the cigarette that is intended to be lit, opposite the end that is intended to be placed in the user's mouth or otherwise from which smoke is to be drawn. It is also contemplated that both portions of the wired insert can be provided inside the rolling paper, rather than on the outside surfaces of the rolling paper. That is, the rolling paper 102 can be formed over the wire such that, as a result, the wire portions 108, 110, 112 are essentially embedded in the rolling paper 102. In some embodiments a wire insert can be provided on each rolling paper in a package of rolling papers, which can assist in separating the rolling papers for user. FIG. 2 shows a side view of a wire holder 106 for a rolling paper 102. In this view the portions 108, 112 are in line with each other, and the clasp loop or hook 114 can be seen as extending under, and then over the first portion 108 near the handle 116.

Figure 3A:
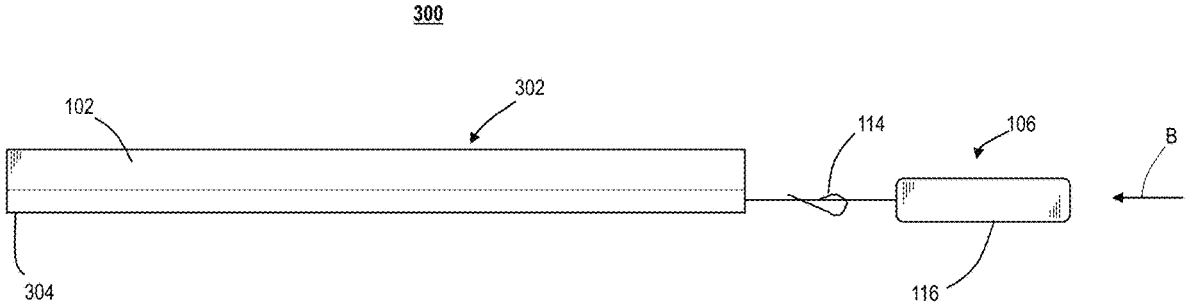
FIG. 3A shows a side view of a rolled cigarette made with a rolling paper having an attached wire holder, in accordance with some embodiments.
Figure 3B:
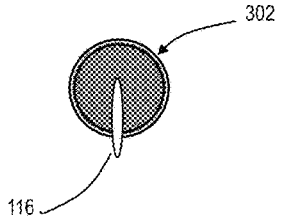
FIG. 3B shows a front view of a rolled cigarette having a wire holder with a paddle-shaped handle, in accordance with some embodiments.
Figure 3C:
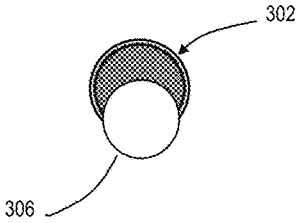
FIG. 3C shows a front view of a rolled cigarette having a wire holder with a cylindrical-shaped handle, in accordance with some embodiments.

FIG. 3A shows a side view 300 of a rolled cigarette 302 made with a rolling paper 102 having an attached wire holder 106, in accordance with some embodiments. After rolling the rolling paper 102 with smoking material inside, the cigarette 302 is formed. The wire holder 106 extends from the combustion end, while a smoking end 304, opposite the combustion end, and configured for smoking. The wire holder 106 includes the handle 116 that the user can grasp to hold the cigarette 302. FIGS. 3B and 3C show views of the rolled cigarette 302 with the wire holder 106 in place looking in the direction of arrow "B." In FIG. 3B the handle 116 is a paddle-type handle having a width that is greater than a thickness through the paddle. In FIG. 3C a cylindrical handle 306 is shown as an alternative. The paddle-type handle 116 can be useful, particularly if the wire extending outside the cigarette, between the cigarette and the handle 116, is bent at an angle as it helps the user orient the cigarette without having to look at it. That is, the user can bend the wire relative to the flat sides of the paddle, and thereby, while holding the paddle handle 116, know the direction of the cigarette from the handle without having to look at the cigarette.

Figure 4:
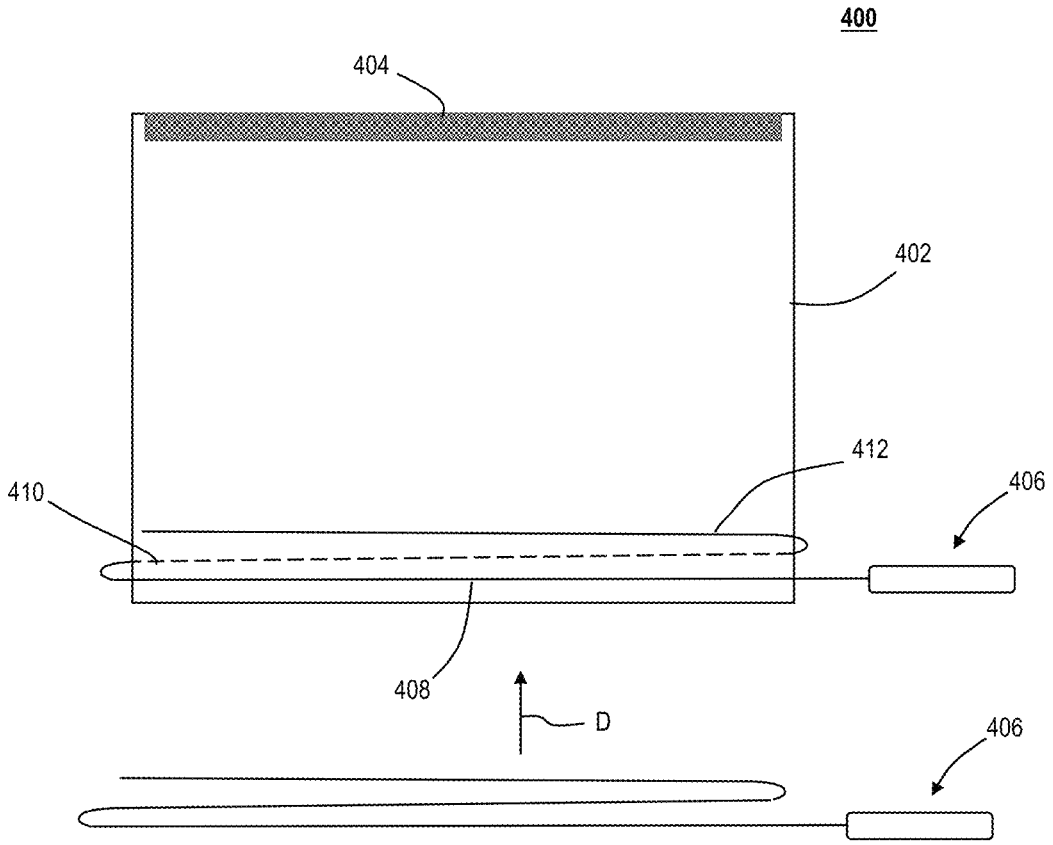
FIG. 4 shows an assembly of a rolling paper with a wire holder, in accordance with some embodiments.

FIG. 4 shows an assembly 400 of a rolling paper 402 with a wire holder 406, in accordance with some embodiments. As an alternative, rather than having two portion of the wire holder 406 that traverse the width of the rolling paper 402, which are secured with a clasping hook (e.g. 114), three lengths 408, 410, and 412 alternate sides of the rolling paper 402. Here, portion 410 is shown in broken line to indicated that it is behind the rolling paper 402 in this view. The wire portions 408, 10, 412 can be adhered to the rolling paper 402 using a gum, such as the gumming strip 404 used at the top edge of the rolling paper 402. In some embodiments the wire can be formed with the three alternating portions 408, 410, 412 and the user can thread or feed the bottom edge of the rolling paper through the portions 408, 410, 412 into the arrangement shown, or an equivalent arrangement, as indicated by the arrow "D." A handle 406 is provided at a terminal end of the wire intended to extend from the front of the cigarette. The wire holder (both 106 and 406, and others to be described) also provides the benefit of adding strength and rigidity to the rolling paper when rolling the cigarette, which can reduce tearing of the rolling paper.

In general, the wire holder (e.g. 106, 406) provided for use with a rolling paper in which the wire is rolled with the rolling paper, include two or more alternating portions that traverse both sides of the rolling paper. Initially the handle portion is substantially in line with the alternating portions of the wire so as to make rolling easier. Once the cigarette is rolled, however, the user can bend the wire adjacent the handle if desired. The handle portion can be used to help roll the rolling paper into a cigarette, as well, and the alternating portions turn the rolling paper and the handle is turned/rolled. A wire having only and single portion along the width of the rolling paper will not impart rotation to the rolling paper unless adhered to the rolling paper, but even then there is a greater chance of the single portion ripping the paper, whereas having alternating portions on opposite sides of the paper adds a "push/pull" effect to help smoothly roll the paper, and the width or lateral distance between the alternating lengths of the wire portions accommodates the smoking material places in the rolling paper when starting the rolling process.

Figure 5A:
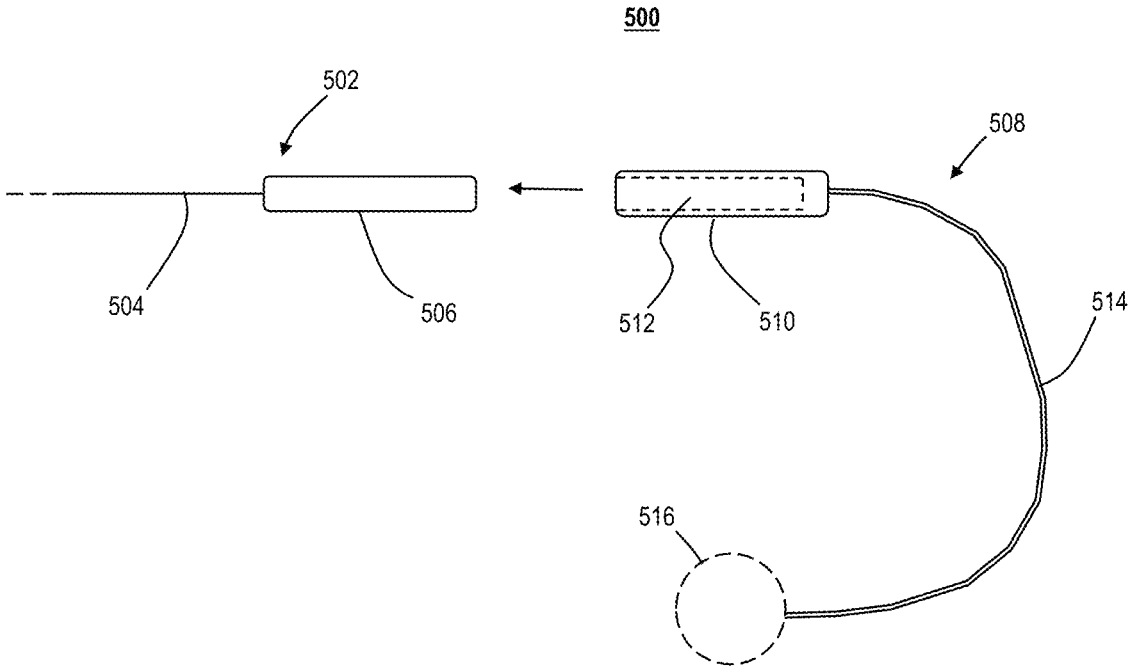
FIG. 5A shows a handle extension for a wire holder used with a rolling paper, in accordance with some embodiments.
Figure 5B:
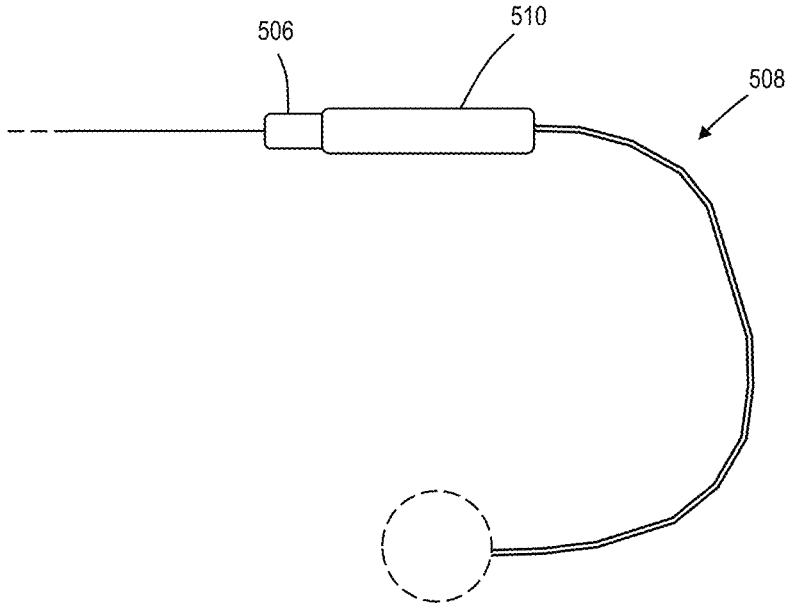
FIG. 5B shows the handle extension assemble onto the handle of the wire holder, in accordance with some embodiments.

FIGS. 5A and 5B shows a handle extension system 500 for a wire holder used with a rolling paper. A wire holder 502 includes a wire portion 504 that has several alternating portions to traverse opposing sides of a rolling paper. The wire portion 504 has a terminal end that is covered with a handle 506. A handle extension 508 includes a handle receiver 510 in which a bore 512 is formed. The bore 512 is formed along an elongated axis of the handle receiver 510 and has a cross section that is sized and shaped to correspond with the cross section shape of the handle 506. A bendable portion 514 is further connected to the holder receiver 510, and can be bent into a shape desired by the user. The bendable portion 514 can be terminated with a decorative item 516 that can be held or left uncovered, as desired by the user. In FIG. 5A the holder extension 508 is not attached to the handle 506, but is moved into engagement with the handle 506 such that the handle 506 is moved into the bore 512 as in FIG. 5B.

Figure 6:
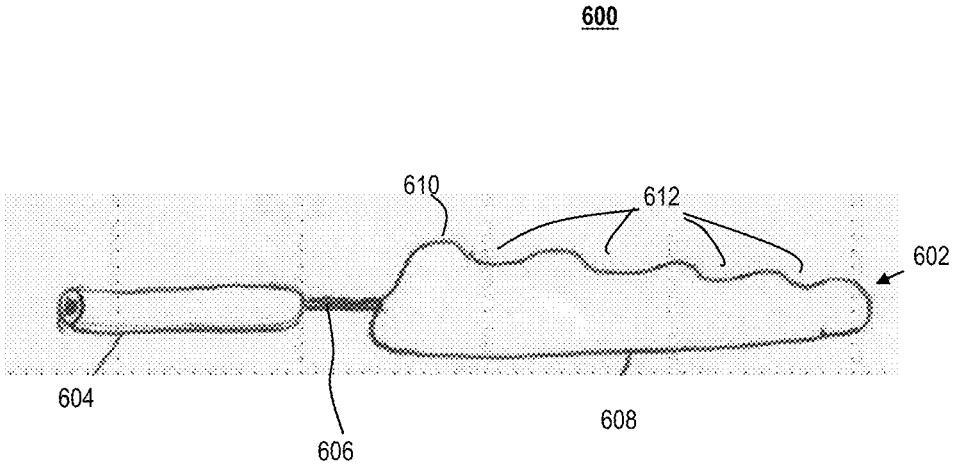
FIG. 6 shows a wire holder for a rolling paper where the wire is formed into a handle shape, in accordance with some embodiments.

FIG. 6 shows a wire holder system 600 for a rolling paper where the wire is formed into a handle shape, in accordance with some embodiments. A wire holder 602 includes a wire portion insert portion 606 that is inside of a rolled cigarette 604. The insert portion 606 at least one length of wire that is substantially as long as the cigarette 604. In such embodiments, the wire can be further formed into a handle 610 that can include several finger positions 612 in which the user can place their fingers. That is, the wire, in addition to having a portion inside the cigarette, is formed into to a loop to create the handle 610, that can be further shaped into an elongated loop with the finger portion 612 formed on one side. The longer handle 610 can be useful when the wire holder is inserted into, for example, a cigar, which is larger and bulkier than a cigarette. Alternatively, the handle 610 can be formed of a separate material than the wire, such as a material similar to that used to make handle 116. In general the handle 610, in such alternative embodiments, can be formed of a thermal insulating material coupled to the wire and having finger portions 612 formed in the material. In such alternative embodiments the handle 610 can be paddle-shaped, meaning it is substantially greater in length and width/height than in thickness through the handle 610.

Figure 7A:
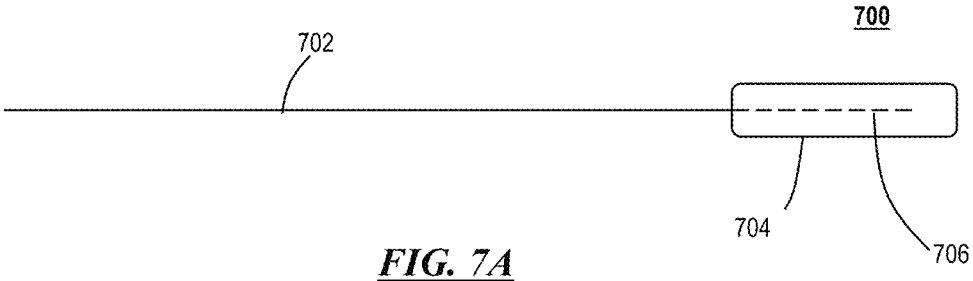
FIGS. 7A and 7B show variations of a wire holder for insertion into a cigar or cigarette, in accordance with some embodiments.

FIG. 7A shows a wire holder 700 for use with cigarettes and other similar smoking items, for insertion into a rolled cigarette. The wire holder 700 include a wire portion 702 that can be a semi rigid, non-reactive metal. Disposed at one end of the wire is a handle 704 that can be integral with the wire 702 (i.e. made of the same material) or made of a separate material that is bonded to the wire 702. When the handle 704 is made of a different material, then a portion 706 (shown in broken line) will be inside the handle 704. The handle 704 can be paddle or cylindrically shaped.

Figure 7B:
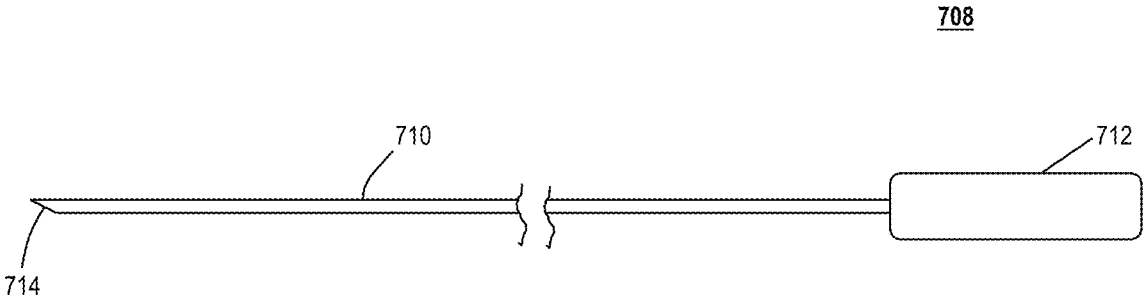

FIG. 7B shows a wire holder 708 for insertion into a cigar or cigarette, in accordance with some embodiments. The wire holder 708 is intended to be inserted into a smoking item, rather than attached to a rolling paper or otherwise applied to a rolling paper prior to rolling the smoking item. The wire holder 708 includes a wire insert portion 710 having a length intended to be at least as long as the smoking item into which is it inserted. A handle 712 is formed at a terminal or distal end of the wire, and can be substantially similar to the handles described hereinabove. The wire 710 is intended to be a heavier gauge than the wire shown, for example, in FIG. 7A, forming a linear shaft, and has a proximal end 714 that is cut an angle to create a sharp point for penetrating into the smoking item. The angle of the cut can be in the range of twenty to forty five degrees relative to axis of the wire 710. Cigarettes comprise chopped up bits of tobacco or other smoking material, and cigars are full tobacco leaves wrapped together. Cigars need the leaves wrapped in one direction so that air flows through them when drawing the cigar. The stiff wire should not bend when inserted (carefully) into the rolled cigar.

Figure 8A:
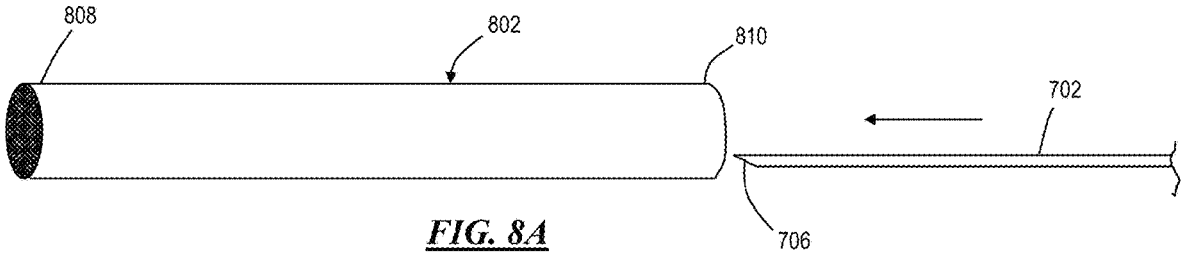
FIGS. 8A-8C show a progression of insertion of a wire holder and subsequent smoking of a cigar or cigarette with the wire holder inserted, in accordance with some embodiments.
Figure 8B:
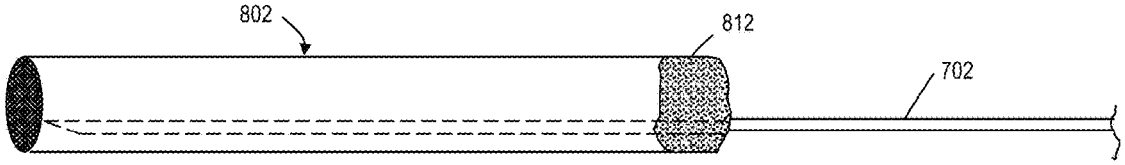
Figure 8C:
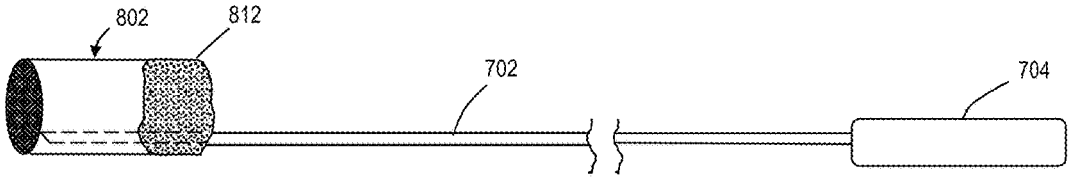
Figure 9:
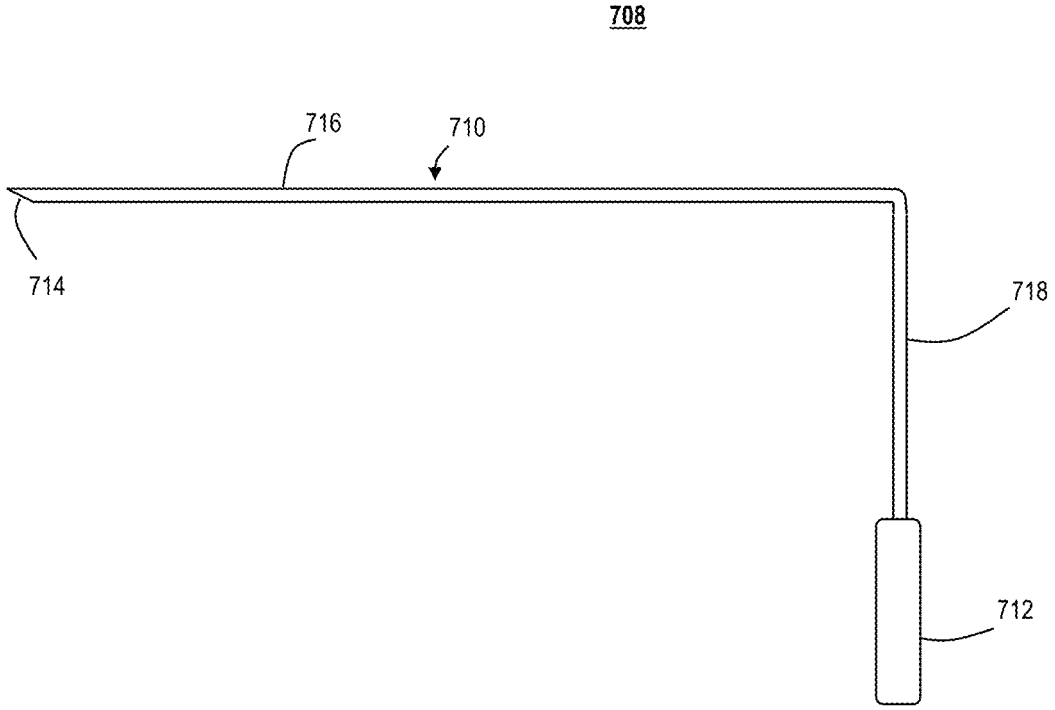
FIG. 9 shows a wire holder, that is bent at an angle, for insertion into a cigar or cigarette, in accordance with some embodiments.

FIGS. 8A-8C show a progression of insertion of a wire holder and subsequent smoking of a cigar or cigarette with the wire holder inserted, in accordance with some embodiments. The wire holder shown in these drawings is substantially equal to that shown in FIG. 7. A smoking item 802, such as a cigar, has a burning end 810 and a smoking end 808. The burning end 810 is the end that burn, and smoke is drawn through the smoking item 802 to the smoking end 808 by a user. In FIG. 8A a wire holder includes a wire portion 710 that has a sharpened end 714 that in inserted into the smoking item 802 to hold the smoking item 802. In FIG. 8B the wire holder in in place and the smoking item 802 has a burning portion 812. In FIG. 8C the burning portion 812 has moved along the smoking item 802. The wire holder supports the smoking item such that the user does not have to hold the smoking item, particularly when the burning portion 812 is close to the smoking end, where the user's fingers would be adjacent to the burning portion 812. Thus, the wire holder provided the benefit of allowing a user to smoke more of the smoking item comfortably. FIG. 9 shows the wire holder bent at an angle, in accordance with some embodiments. The wire portion 710 of the wire holder 708 can be bent into an insert portion 716 that is inserted into the smoking item (e.g. 802), and an external portion 718 between the insert portion 716 and the handle 712 to allow the user to hold the smoking item in a different position, similar to a pipe. The wire holder 708 can be bent by the user such that the insert portion 716 has a desired length.

Figure 10A:
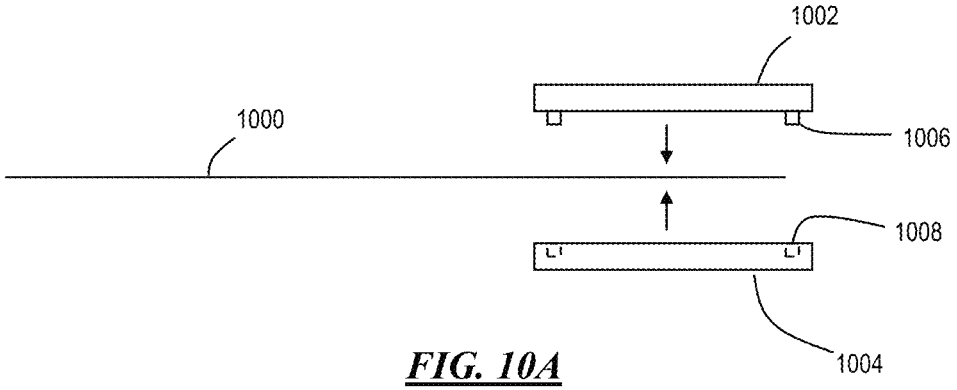
FIGS. 10A-10B show side and end views of a snap-together handle for a wire holder, in accordance with some embodiments.
Figure 10B:
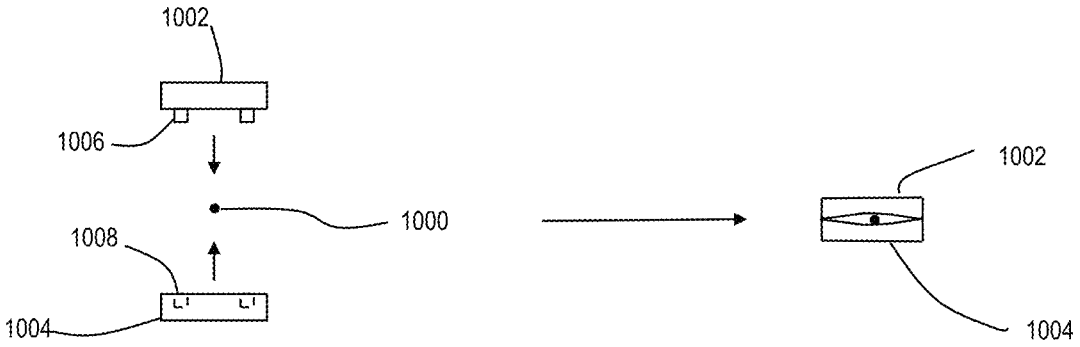

FIGS. 10A-10B show side and end views of a snap-together handle for a wire holder, in accordance with some embodiments. A length of wire 1000 is provided and two opposing halves 1002, 1004 of a handle are provided at an end of the wire 1000. The handle halves 1002, 1004 have mating snap features 1006, 1008 that fit together in an interference/retention arrangement such that force is exerted against the wire 1000 as a result of the snap features holding the halves 1002, 1004 together. That is, some plastic deformation occurs when snapping the halves together, and the resulting force traps and retains the wire 1000 between the halves 1002, 1004. The halves can be made of plastic, and can be formed to create a paddle-type or a cylindrical-type handle, or any other desired shape handle.

Figure 11:
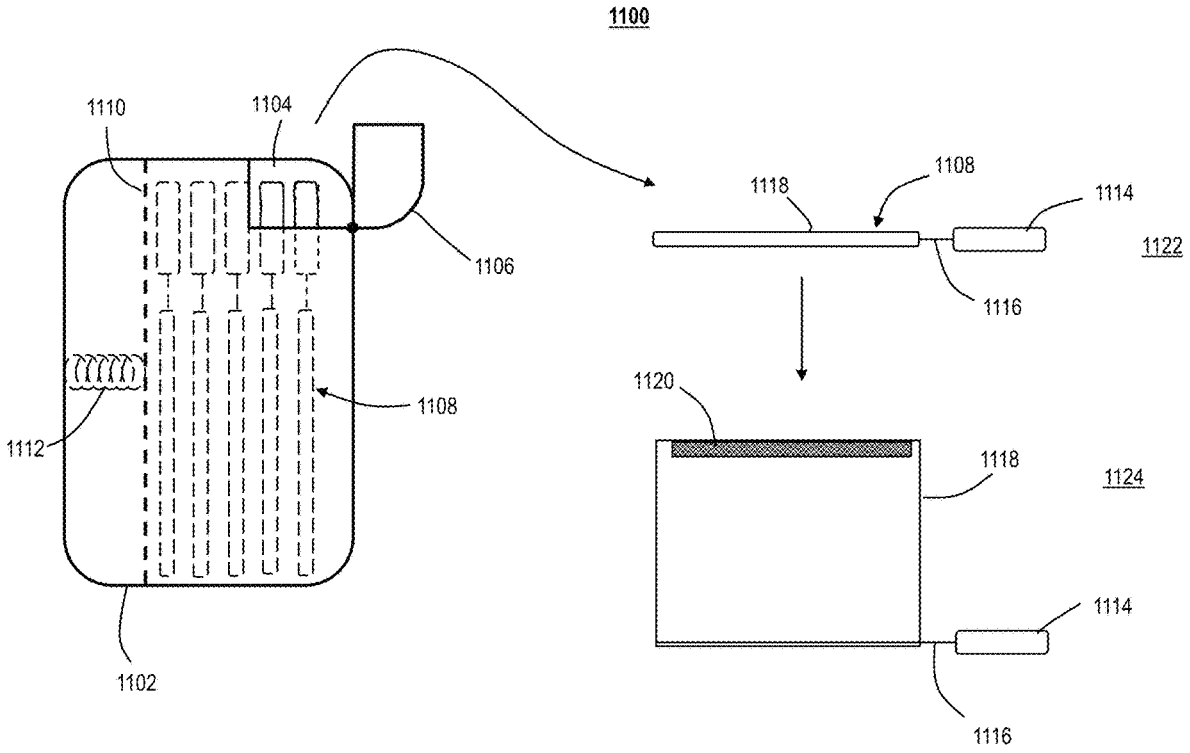
FIG. 11 shows a carrying and dispending system for wire holders to be used to hold smoking items, in accordance with some embodiments.

FIG. 11 shows a carrying and dispending system 1100 for wire holders to be used to hold smoking items, in accordance with some embodiments. A case 1102 is used to hold several wire holders 1108 that may or may not include an attached and rolled rolling paper 1118. The wire holders 1108 are urged, by a spring 1112 pushing against a follower 1110 in the case 1102 towards an opening 1104 in the case. The opening 1104 can be accessed by moving a cap 1106 or similar portion of the case 1102. Upon removing a wire holder 1108, as in position 1122, the rolling paper 1118 is rolled around the wire 1116. The wire holder 1108 also includes a handle 1114 substantially as handle 116. In state 1124, the rolling paper is unrolled and ready for use, exposing the gumming portion 1120. The wire 1116 can be bonded to the rolling paper 1118, and can include one or more alternating portions on opposite sides of the rolling paper 1118, as shown, for example in FIG. 1. Alternatively, the wire 1116 can be formed with only a single portion that is bonded to the paper 1118, such as by the paper 1118 being formed over the wire 1116.

A wire holder has been disclosed for use with a smoking item, or similar items that are carried. The wire holder can be provided attached to, or separate from rolling papers. Inventive embodiments of the wire holder can also be inserted into a completed/rolled smoking item. The wire holder uses a rigid or semi-rigid, non-reactive wire material that holds its shape and does not produce chemical by-products when exposed to the burning material. In addition to smoking materials, the wire holder can be used with similarly wrapped material that is burned, such as, for example, herbs (e.g. sage) and incense.

What is claimed is:

1. A wire insert fora rolling paper, comprising:

a first portion having a length substantially equal to a width of the rolling paper that extends from a second end to a first end of the wire insert:

a second portion having a length substantially equal to the width of the rolling paper, the second portion coupled to the first portion at the first end of the wire insert, and extending along the first portion from the first end to the second end, spaced apart from the first portion;

wherein the first portion is configured to be on a first side of the rolling paper and the second portion is configured to be on a second side of the rolling paper; and a thermal insulator on an extension of the first portion at the second end of the wire insert that is configured to extend beyond an edge of the rolling paper at the second end when the rolling paper is inserted between the first portion and the second portion;

wherein the wire insert is attached to the rolling paper.

2. The wire insert of claim 1, wherein the second portion has an engagement feature that engages the first portion at the second end of the wire insert.

3. The wire insert of claim 1, further comprising a third portion having a length substantially equal to the width of the rolling paper which extends from the second portion at the second end of the wire insert along the first and second portions and is configured to be on the first side of the rolling paper.

4. The wire insert of claim 3, wherein the first and third portions are substantially parallel to each other.

5. The wire insert of claim 1, further comprising further comprising an extender that is configured to engage the thermal insulator and is configured to be held in a hand of the user.

6. The wires insert of claim 5, wherein the extender comprises a hand grip.

7. A method for making a rolling paper for rolling a cigarette having a handle, comprising:

providing a rolling paper, the rolling paper having a width;

providing a wire insert having:

a first portion having a length substantially equal to the width of the rolling paper, wherein the first portion extends from a second end to a first end;

a second portion coupled to the first portion at the first end and extending from the first end to the second end along the first portion;

a thermal insulator disposed on an extension of the wire insert, wherein the extension extends from first portion at the second end; and placing a bottom edge of the rolling paper between the first portion and the second portion of the wire insert.

8. The method of claim 7, further comprising:

attaching the rolling paper to the first portion of the wire insert on a first side surface of the rolling paper; and attaching the rolling paper to the second portion of the wire insert on a second side surface of the rolling paper.

9. The method of claim 8, wherein providing the rolling paper further comprises providing the rolling paper with a gummed material along a top edge of the rolling paper that is opposite the bottom edge.

10. The method of claim 7, wherein providing the wire insert comprises providing a hook at the second end of the second portion that engages the first portion at the second end.

11. The method of claim 7, wherein providing the wire insert further comprises providing a third portion that extends from the second end of the second portion to the first end of the wire insert along the first and second portions of the wire insert.

12. The method of claim 7, wherein providing the thermal insulator comprises providing a snap-together handle including a first half and a second half that snap together on the extension.

* * * * *